US007255624B2

(12) United States Patent
Daftari

(10) Patent No.: US 7,255,624 B2
(45) Date of Patent: Aug. 14, 2007

(54) ILLUMINATED, THREE-DIMENSIONAL MODULES FOR A MAGNETIC TOY CONSTRUCTION KIT

(75) Inventor: Parvis Daftari, Summit, NJ (US)

(73) Assignee: MEGA Brands America, Inc., Livingston, NJ (US)

( * ) Notice: Subject to any disclaimer, the term of this patent is extended or adjusted under 35 U.S.C. 154(b) by 0 days.

(21) Appl. No.: 11/249,372

(22) Filed: Oct. 14, 2005

(65) Prior Publication Data

US 2006/0131989 A1 Jun. 22, 2006

Related U.S. Application Data

(60) Provisional application No. 60/619,276, filed on Oct. 15, 2004.

(51) Int. Cl.
*A63H 33/04* (2006.01)

(52) U.S. Cl. ..... 446/92; 446/91; 446/485

(58) Field of Classification Search ..... 446/85, 446/91, 92, 129, 137, 219, 485
See application file for complete search history.

(56) References Cited

U.S. PATENT DOCUMENTS

| | | | | |
|---|---|---|---|---|
| 242,821 | A | 6/1881 | Farmer | |
| 1,236,234 | A | 8/1917 | Troje | |
| 1,535,035 | A | 4/1925 | Philipp | |
| 2,448,692 | A | 9/1948 | Teetor | |
| 2,570,625 | A | 10/1951 | Zimmerman et al. | |
| 2,795,893 | A | 6/1957 | Vayo | |
| 2,846,809 | A | 8/1958 | Majewski | |
| 2,872,754 | A * | 2/1959 | Cronberger | 446/92 |
| 2,939,243 | A | 6/1960 | Duggar | |
| 2,970,388 | A | 2/1961 | Yonkers | |
| 2,983,071 | A | 5/1961 | Oliver | |

(Continued)

FOREIGN PATENT DOCUMENTS

| | | |
|---|---|---|
| DE | 31 52 024 | 7/1983 |

(Continued)

OTHER PUBLICATIONS

German Office Action, Jun. 27, 2002.

(Continued)

*Primary Examiner*—John A. Ricci
(74) *Attorney, Agent, or Firm*—Michael Bednarek; Paul, Hastings, Janofsky & Walker LLP

(57) ABSTRACT

A construction kit that is suitable for creating a variety of different structures includes a plurality of illuminated elements. In one embodiment, an illuminated element has a plurality of substantially transparent panels forming a three-dimensional shape, a self-powered light cartridge within the three-dimensional shape, and a plurality of externally directed magnets. The cartridge can include a housing disposed on a panel of the plurality of substantially transparent panels, a light located within the housing and positioned approximately in the center of the three-dimensional shape, circuitry within the housing for controlling an operation of the light, a battery within the housing for powering the light via the circuitry, and a removable cover for sealing the light, circuitry and battery within the housing. The illuminated elements can be directly connected to each other with the externally directed magnets or with connecting members (e.g., ferromagnetic spheres) between the magnets.

18 Claims, 7 Drawing Sheets

U.S. PATENT DOCUMENTS

| | | | |
|---|---|---|---|
| 3,077,696 | A | 2/1963 | Barnett et al. |
| 3,095,668 | A | 7/1963 | Dorsett |
| 3,184,882 | A | 5/1965 | Vega |
| 3,196,579 | A | 7/1965 | Lepper |
| 3,254,440 | A | 6/1966 | Duggar |
| 3,458,949 | A | 8/1969 | Young |
| 3,594,924 | A | 7/1971 | Baker |
| 3,601,921 | A | 8/1971 | Strohmaier |
| 3,606,333 | A | 9/1971 | Green |
| 3,655,201 | A | 4/1972 | Nichols |
| 3,696,548 | A | 10/1972 | Teller |
| 3,706,158 | A | 12/1972 | Jensen |
| 3,906,658 | A | 9/1975 | Gross |
| 3,998,003 | A | 12/1976 | Rosenbaum |
| 3,998,004 | A | 12/1976 | Ehrlich |
| 4,020,566 | A | 5/1977 | Dreiding |
| 4,026,086 | A | 5/1977 | Langley |
| 4,118,888 | A | 10/1978 | Ogawa |
| 4,238,905 | A | 12/1980 | MacGraw, II |
| 4,258,479 | A | 3/1981 | Roane |
| D264,694 | S | 6/1982 | Takahashi |
| 4,334,870 | A | 6/1982 | Roane |
| 4,334,871 | A | 6/1982 | Roane |
| 4,364,196 | A | 12/1982 | Shacket |
| 4,462,596 | A | 7/1984 | Yamamoto |
| 4,509,929 | A | 4/1985 | Zawitz |
| 4,513,970 | A | 4/1985 | Opresco et al. |
| 4,629,192 | A | 12/1986 | Nichols |
| 4,650,424 | A | 3/1987 | Mitchell |
| 4,722,712 | A | 2/1988 | McKenna |
| 4,741,534 | A | 5/1988 | Rogahn |
| 4,836,787 | A | 6/1989 | Boo |
| 4,886,273 | A | 12/1989 | Unger |
| 5,009,625 | A | 4/1991 | Longuet-Higgins |
| 5,021,021 | A | 6/1991 | Ballard |
| 5,127,652 | A | 7/1992 | Unger |
| 5,347,253 | A | 9/1994 | Ogikubo |
| 5,409,236 | A | 4/1995 | Therrien |
| 5,411,262 | A | 5/1995 | Smith |
| 5,458,522 | A | 10/1995 | Brooks, III |
| 5,487,691 | A | 1/1996 | Chiu |
| 5,520,396 | A | 5/1996 | Therrien |
| 5,545,070 | A | 8/1996 | Liu |
| 5,643,038 | A | 7/1997 | Olsen et al. |
| 5,651,715 | A | 7/1997 | Shedelbower |
| 5,743,786 | A | 4/1998 | Lindsey |
| 5,746,638 | A | 5/1998 | Shiraishi |
| 5,785,529 | A | 7/1998 | Hearn et al. |
| 5,826,872 | A | 10/1998 | Hall |
| 5,833,465 | A | 11/1998 | Jarzewiak |
| 5,848,926 | A | 12/1998 | Jardetzky et al. |
| 5,873,206 | A | 2/1999 | Roberts |
| 5,993,282 | A * | 11/1999 | Ernst ..... 446/124 |
| 6,017,220 | A | 1/2000 | Snelson |
| 6,024,626 | A | 2/2000 | Mendelsohn |
| 6,090,431 | A | 7/2000 | Franklin et al. |
| 6,116,981 | A | 9/2000 | Zheng |
| 6,158,740 | A | 12/2000 | Hall |
| 6,241,249 | B1 | 6/2001 | Wang |
| 6,256,914 | B1 | 7/2001 | Yeh |
| 6,277,428 | B1 | 8/2001 | Franklin et al. |
| 6,280,282 | B1 | 8/2001 | Puchalski |
| 6,386,540 | B1 | 5/2002 | Stevkovski |
| 6,431,936 | B1 | 8/2002 | Kiribuchi |
| 6,491,563 | B1 | 12/2002 | Bailey |
| 6,566,992 | B1 | 5/2003 | Vicentelli |
| 6,626,727 | B2 | 9/2003 | Balanchi |
| 6,749,480 | B1 | 6/2004 | Hunts |
| 6,846,216 | B1 | 1/2005 | Balanchi |
| 6,963,261 | B2 | 11/2005 | Vicentelli |
| 6,969,294 | B2 | 11/2005 | Vicentelli |
| 7,066,778 | B2 * | 6/2006 | Kretzschmar ..... 446/92 |
| 2002/0115373 | A1 | 8/2002 | Lazerman |
| 2002/0135125 | A1 | 9/2002 | Wu |
| 2002/0167127 | A1 | 11/2002 | Fang |
| 2004/0018473 | A1 | 1/2004 | Tusacciu |
| 2004/0063380 | A1 | 4/2004 | Chi et al. |

FOREIGN PATENT DOCUMENTS

| | | |
|---|---|---|
| DE | 33 23 489 | 1/1984 |
| DE | 39 10 304 | 10/1990 |
| DE | 102 07 244 | 2/2002 |
| DE | 202 02 183 | 2/2002 |
| FR | 2 153 792 | 9/1971 |
| FR | 2 301 279 | 2/1975 |
| GB | 2 123 306 | 2/1984 |
| JP | 2001-173889 | 6/2001 |
| WO | WO89/10604 | 11/1989 |
| WO | WO99/60583 | 11/1999 |
| WO | WO 02/055168 | 7/2002 |
| WO | WO 02/076565 | 10/2002 |

OTHER PUBLICATIONS

International Search Report, Apr. 14, 2003.
Magna-Tiles Instruction Booklet, date unknown.
Gorbert, Matthew G., Orth, Maggie, and Ishii, Hiroshi, *Triangles: Tangible Interface for Manipulation and Exploration of Digital Information Topography*, Proceedings CH1/98, Apr. 18-23, 1998, pp. 49-56, CHI 98.

* cited by examiner

ILLUMINATED, THREE-DIMENSIONAL MODULES FOR A MAGNETIC TOY CONSTRUCTION KIT

This application claims the benefit of U.S. Provisional Application No. 60/619,276, filed Oct. 15, 2004, which is herein incorporated by reference in its entirety.

BACKGROUND

1. Field of the Invention

The present invention is directed generally to puzzles and toys. More particularly, the present invention is directed to construction toys for building stable three-dimensional structures utilizing various construction elements, at least some of which have luminescent characteristics.

2. Background of the Invention

Individuals often find enjoyment in the challenge of building aesthetic structural designs and/or functional structural models. Frequently, the utility associated with constructing such structures is found in the creative and/or problem-solving process required to achieve a desired structural objective. Currently, construction assemblies that exploit magnetic properties to interlink various structural components and thereby form different three-dimensional structures are known and can provide an added dimension of sophistication to the construction process. Examples of such construction assemblies include the magnetic construction toy disclosed in Balanchi U.S. Pat. No. 6,626,727, the modular assemblies disclosed in Vicentielli U.S. Pat. No. 6,566,992, and the magnetic puzzle/toy disclosed in Smith U.S. Pat. No. 5,411,262. In particular, German Patent No. DE 202 02 183 U1 to Kretzschmar describes flat triangles, squares and rectangles used in conjunction with ferromagnetic balls to create a limited range of geometric constructions. The flat shapes disclosed in the Kretzschmar German Patent consist of magnets inserted in the corners of a triangular or square piece, or six magnets in a rectangular plate that can be attracted to steel balls to create three-dimensional shapes. Thus, conventional construction kits are appealing to persons of all ages in that they allow for both aesthetic and geometric creativity.

The above-noted magnet construction assemblies each contain a certain number of component parts, which can sometimes limit geometries and stable or secure connections. Thus, a need remains for a magnetic construction assembly that provides more flexibility in both aesthetic and geometric design, and, moreover, that provides an additional degree of design/construction sophistication.

BRIEF SUMMARY OF THE INVENTION

The present invention provides new and improved construction modules that are three-dimensional in shape and have internal light-emitting attributes.

In one embodiment of the invention, a construction kit includes a plurality of construction modules. Each construction module includes a plurality of externally directed magnets, and a self-powered light cartridge arranged within a three-dimensional of the construction module. The plurality of externally directed magnets allows the plurality of construction modules to connect to form a structure.

Additional features and advantages of the invention will become apparent with reference to the following detailed description of exemplary embodiments thereof.

BRIEF DESCRIPTION OF THE DRAWINGS

For a more complete understanding of the present invention, reference is made to the following detailed description of various exemplary embodiments thereof, considered in conjunction with the accompanying drawings, in which.

DETAILED DESCRIPTION OF THE INVENTION

In accordance with one embodiment of the present invention, construction modules having three-dimensional shapes such as that of cubes, cylinders, pyramids, prisms and other shapes are provided having walls or side panels made of translucent or transparent material and forming an interior chamber, in which is disposed a self-powered light cartridge containing an LED light source for illuminating such modules from within. Each such construction module is sized for easy manipulation and includes a number of externally-directed magnets for use in integrating multiple instances of such modules together, via a construction system and method involving intervening steel balls and/or other compatible construction elements.

In an alternative embodiment, self-illuminating construction elements, such as cylinders, cubes, pyramids, prisms and other shapes, formed of translucent or transparent material enclose a light source, such as an LED, miniature incandescent light bulb or electro-luminescent phosphor that is energized by an external power source. Connectors link the elements mechanically.

In accordance with the preferred embodiments disclosed herein, sturdy, attention-getting constructions may thus be assembled which can take a wide variety of forms and/or sizes. Moreover, the internal illumination feature of the three-dimensional construction modules provides a wide variety of aesthetically appealing and entertaining lighting options.

Figure 1:
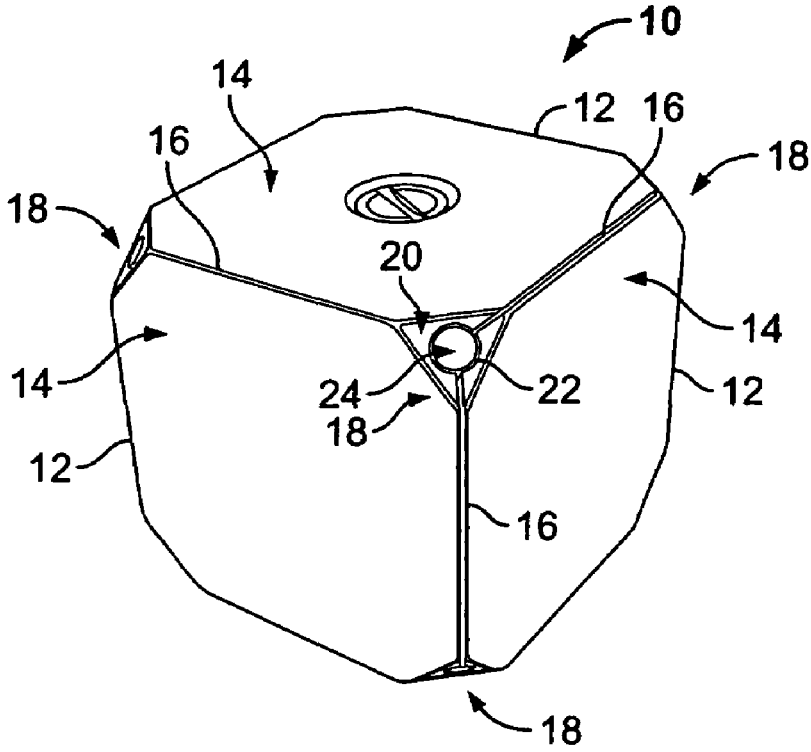
FIG. 1 is a perspective view of a construction module constructed in accordance with a first embodiment of the present invention, wherein the three-dimensional shape thereof is that of a cube.

Referring to FIG. 1, there is shown a construction module 10 configured in accordance with a first embodiment of the present invention, featuring interior lighting and other features to facilitate the assembly of attractive, sturdy constructions of the type described hereinabove. The construction module 10 is three-dimensional, including multiple panels 12 made of translucent material. The panels 12 are sized, shaped, and configured so as to form a cube having six substantially flat side surfaces 14 adjoined along adjacent edges 16 and at eight corners 18. Each of the eight corners 18 of the cube consists of a generally flat beveled surface 20 that forms a 45-degree angle with respect to each of the adjacent side surfaces 14. A magnet 22 is embedded within the beveled surface 20 of each corner 18 and supported by other structure (e.g., an internal pocket or finger-type support such as are discussed more fully hereinafter) such that a generally flat end surface 24 of each magnet 22 is substantially coplanar with the adjacent beveled surface 20. The construction and function of the magnet 22 will be described more fully hereinafter.

Figure 2:
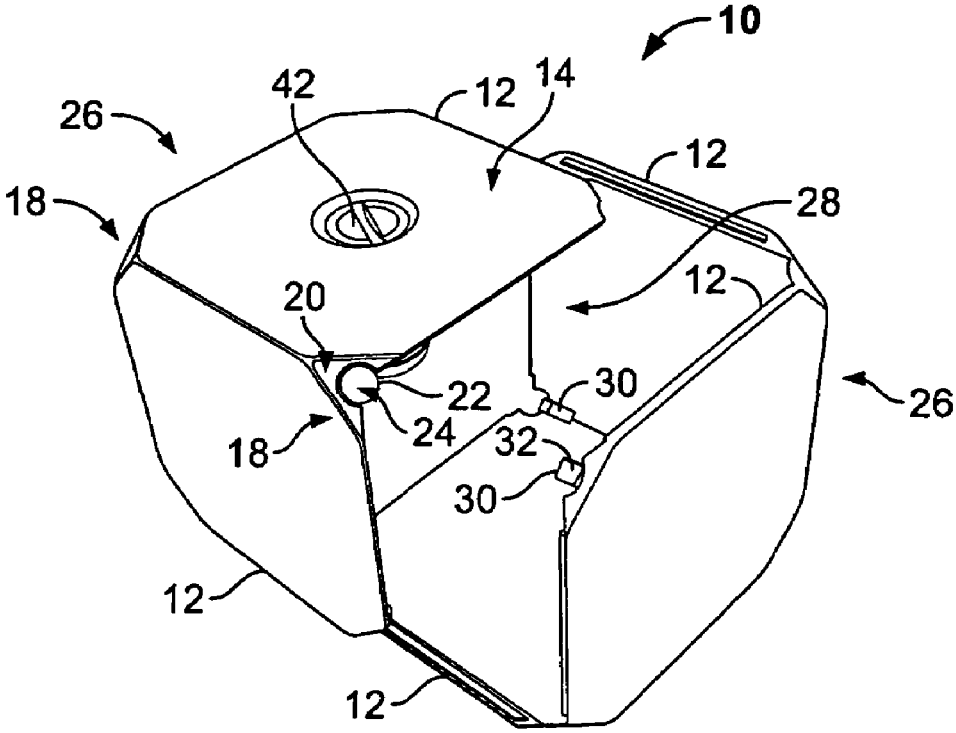
FIG. 2 is a view of the construction module of FIG. 1, shown partially disassembled.
Figure 3:
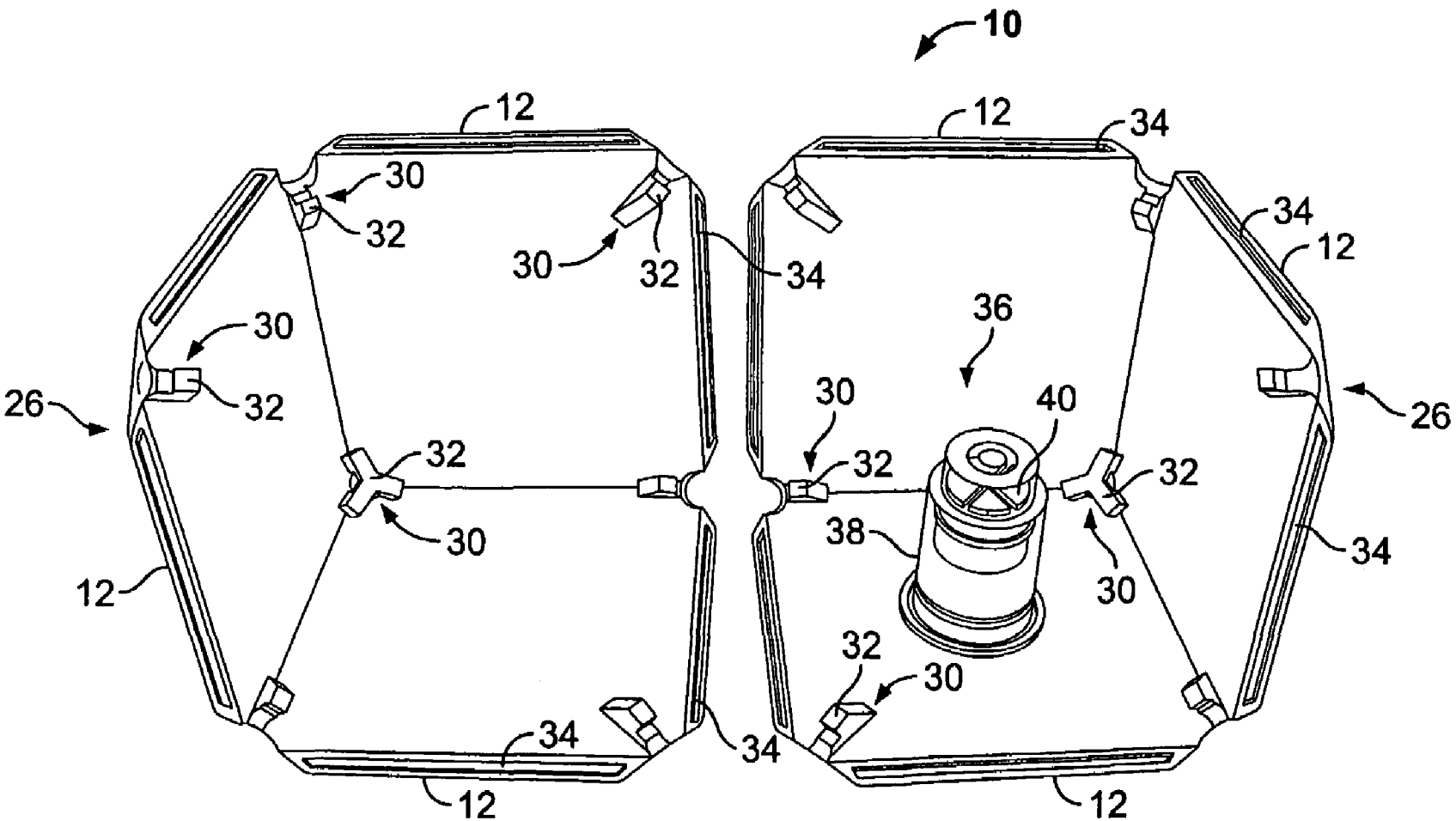
FIG. 3 is a view of the construction module of FIG. 1, shown in a more fully disassembled state.

As shown in FIGS. 2 and 3, the construction module 10 is formed from two substantially equivalent halves 26, each half 26 being of unitary construction (e.g., via molded construction) and including three panels 12. In the assembled state, the two halves 26 define an interior chamber 28 (FIG. 2). Each half 26 includes various magnet support elements 30 disposed in the interior chamber 28 and positioned adjacent the beveled surface 20 of each corner 18. Each magnet support element 30 includes a finger 32 extending beneath an associated beveled surface 20 for supporting the corresponding magnet 22. The positions and dimensions of the fingers 32 and the lengths of the magnets 22 are coordinated so as to keep the externally facing magnet end surfaces 24 coplanar with the associated beveled surfaces 20 in which the magnets 22 are embedded. Each half 26 further includes grooves 34 formed along the periphery of the constituent panels 12. These grooves 34 are precisely formed such that when the halves 26 are joined (e.g., via ultrasonic welding), superior fit and alignment is achieved along the edges 16 (FIG. 1), and sharp corners are avoided in the assembly.

As best shown in FIG. 3, the construction module 10 is further equipped with a light cartridge 36 affixed to one of the panels 12. The light cartridge 36 includes a housing 38 containing an LED light 40, one or more batteries (not shown) to provide electrical power to the LED light 40, and circuitry (not shown) to control the operation of the LED light 40. The circuitry can provide, for example, motion-activated or sound-activated lights. The housing 38 extends from the side surface 14 (FIG. 2) of the panel 12 to which it is affixed, through such panel 12, and into the interior chamber 28, such that the LED light 40 is positioned approximately in the center of the interior chamber 28. The LED light 40 is thereby optimally positioned with respect to the interior chamber 28 for providing the construction module 10 with pleasant and attractive interior lighting, the nature and function of which will be described in greater detail hereinafter.

The light cartridge 36 is further equipped with a removable cover 42 (FIG. 2) for sealing the lighting, power, and control components of the light cartridge 36 within the housing 38. The cover 42 is positioned within the panel 12 to which the light cartridge 36 is affixed. To prevent the structure of the light cartridge 36 and/or the cover 42 from interfering with later assembly/construction steps (to be discussed in more detail hereinafter), the cover 42 is recessed slightly with respect to the side surface 14 of the panel 12.

Figure 4:
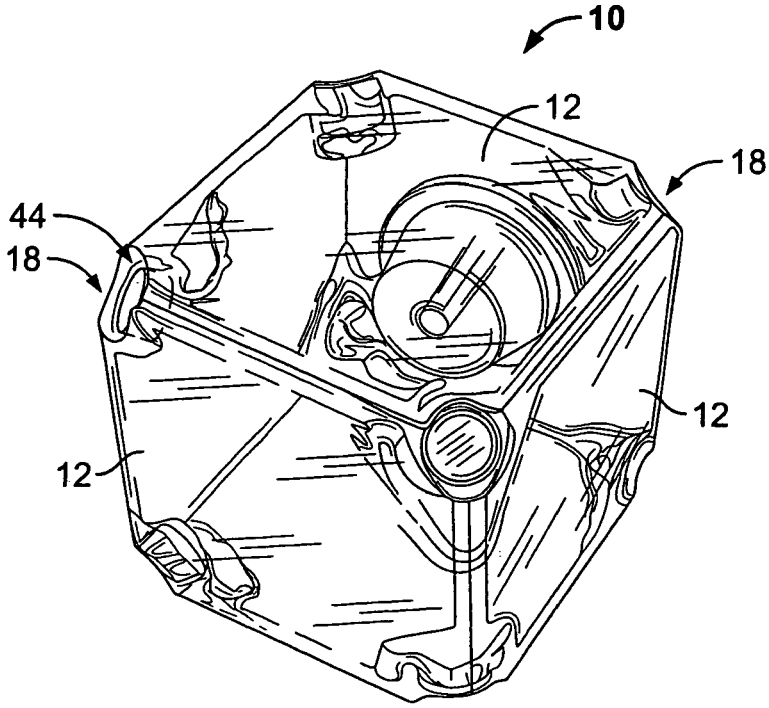
FIG. 4 is a perspective view of a transparent version of the construction module of FIGS. 1-3.
Figure 5:
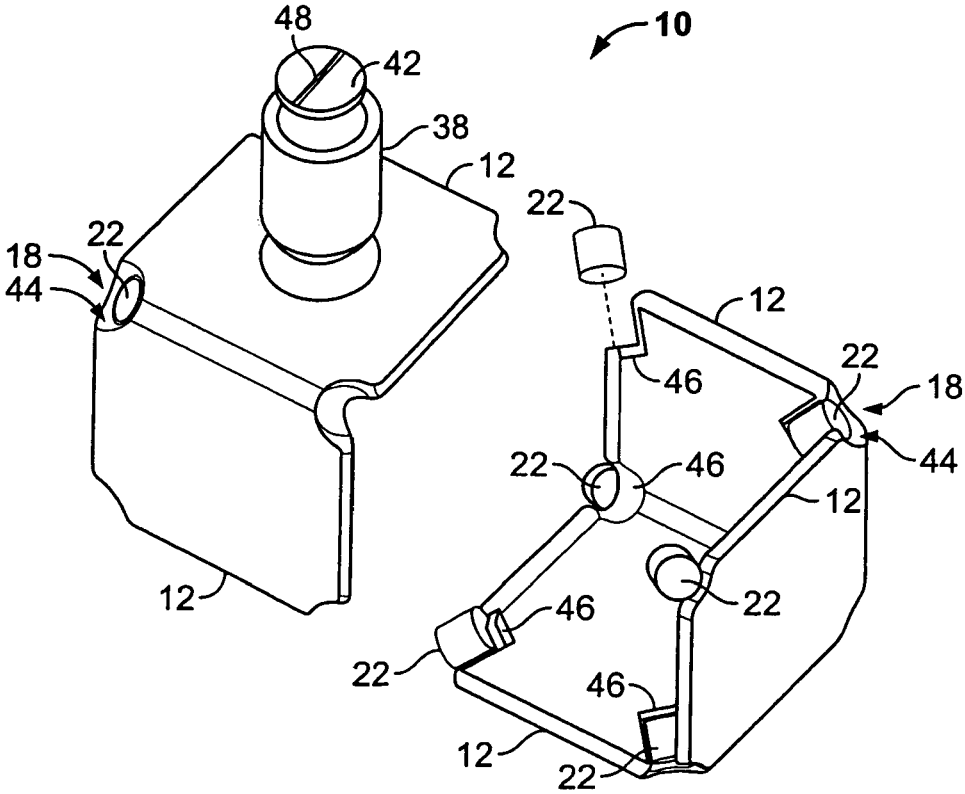
FIG. 5 is a perspective exploded view of another version of the construction module of FIGS. 1-3.

FIGS. 4 and 5 illustrate two variations of the construction module 10 described hereinabove with reference to FIGS. 1-3. As shown in FIG. 4, if desired, the panels 12 of the construction module 10, rather than being merely translucent, can be substantially transparent. As shown in FIGS. 4 and 5, the corners 18 of the cube formed by the panels 12 of the construction module 10 can include a concave surface or socket 44 rather than including flat beveled surfaces. Referring to FIG. 5, cylindrical cups 46 can be provided under the sockets 44 to receive and support the magnets 22 rather than the finger-equipped magnet support elements 30 of FIGS. 2-3.

As also shown in FIG. 5, the magnets 22 can be substantially cylindrical in shape to fit within the cylindrical cups 46, and the cover 42 of the light cartridge 36 can include a slot 48 and exterior threads (not shown) so as to facilitate the use of a screwdriver to gain access to the contents of the housing 38 (e.g., to replace the lighting, control, and/or power components therein), and to secure the cover 42 to the housing 38 via internal threads (not shown) formed therein.

Figure 6:
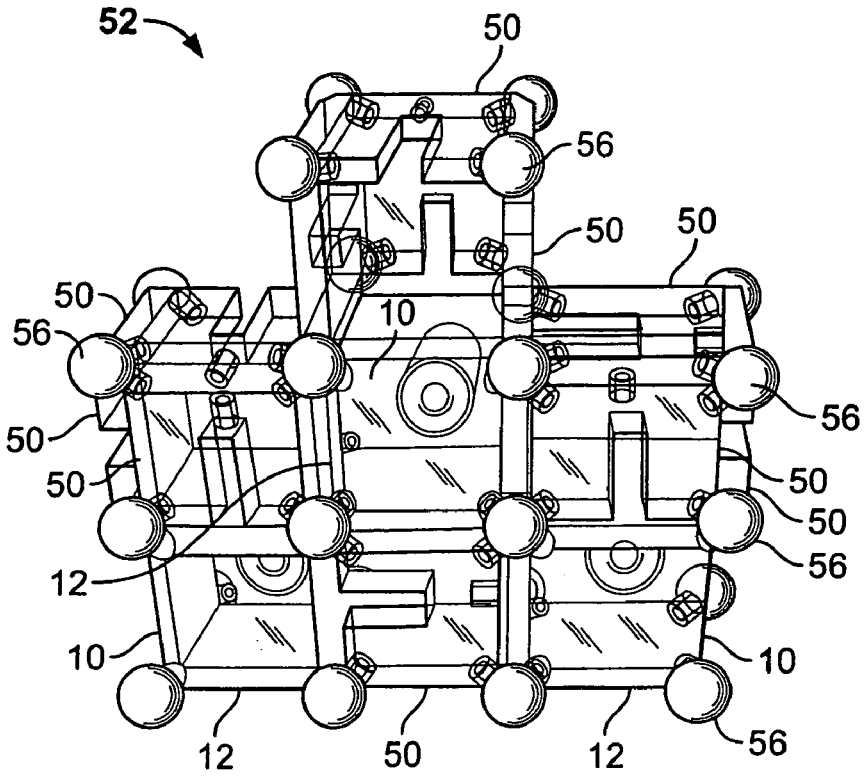
FIG. 6 is a perspective view of an construction composed in part of multiple instances of the FIG. 4 transparent version of the construction module of FIGS. 1-3.
Figure 7:
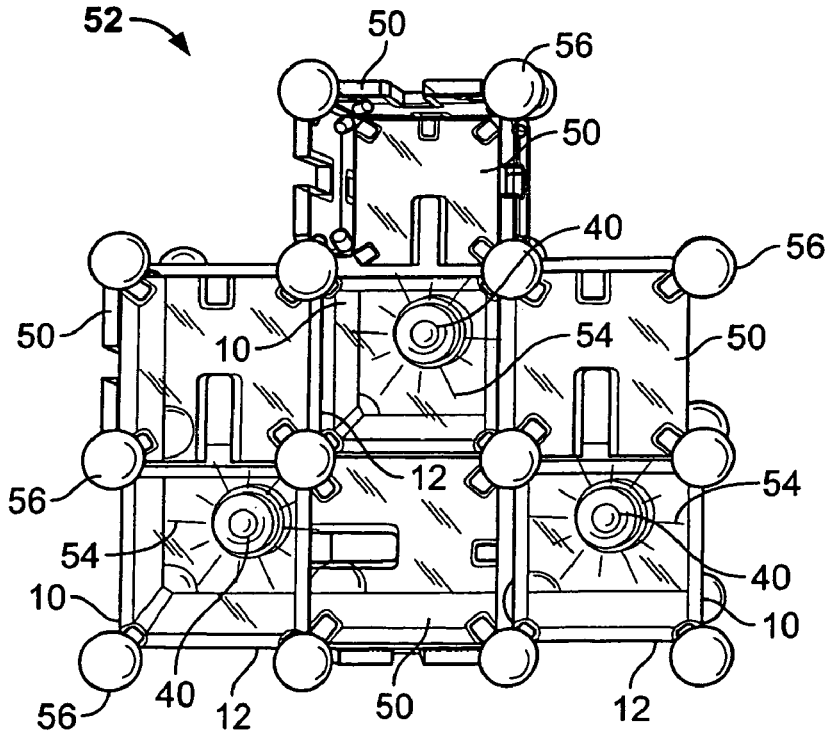
FIG. 7 is another perspective view of the construction of FIG. 6, showing the construction modules to be internally illuminated.

In use, multiple instances of the construction module 10 can be combined with other construction elements in an attractive construction featuring internal lighting and sturdy construction for aesthetic pleasure and/or as a leisure time recreational activity that fosters creativity and stimulates mental development. For example, and as shown in FIGS. 6 and 7, multiple construction modules 10 having transparent panels 12 as discussed above with reference to FIG. 4, can be assembled with each other and with several planar construction elements 50 of constructions (e.g., embedded magnets, transparent in color, approximately the same size as the panels 12 of the construction modules 10, embedded ferromagnetic disks, or connecting rods with embedded magnets or ferromagnetic components) compatible with those of the construction modules 10 (see, for example, applicant's co-pending U.S. patent application Ser. No. 10/966,011 filed Oct. 15, 2004 and entitled "Magnetic Construction Modules For Creating Three-Dimensional Assemblies," the disclosure of which is incorporated herein by reference in its entirety), to form an construction 52. Construction elements 50 also may magnetically couple to one another. Such a construction 52 can be illuminated attractively via light 54 (e.g., red light, blue light, etc.) generated by the LED lights 40 and/or controlled by the circuitry (not shown) in any desired manner (e.g., in multiple colors, with flashing lights, using motion-activated, voice-activated, or sound-activated lights).

The construction 52 can be produced by introducing several stainless steel balls 56 and placing them between the magnets 22 (see FIG. 1) of the construction modules 10 and the magnets of the planar construction elements 50, thereby linking such construction modules and elements via their common magnetic attraction to the steel material. A surprisingly sturdy structure can be created quickly and easily by means of the localized tension forces arising at these precise magnetic interfaces. In at least one advantageous embodiment of the present invention, stainless steel balls 56 having a diameter of 15 mm are used, wherein the construction modules and elements 10, 50 are formed with precise control over their shape and size such that the center-to-center distance of 40.01 mm is produced and maintained between adjacent stainless steel balls 56 in the construction 52. Other ball sizes and center-to-center distances are possible.

Many benefits are provided by the three-dimensional construction modules 10, and/or by a construction 52 containing such construction modules 10 and built in accordance with the foregoing description. The combination of transparent or translucent panels with interior lighting in a conveniently-sized construction module 10 equipped with corner magnets 22 naturally sparks the imagination to produce constructions 52 having one or more of a multiplicity of shapes, lighting colors and/or patterns. The presence of the several stainless steel balls 56 adjacent every corner 18 (FIG. 4) provides numerous surfaces by which the internally generated light may be reflected and/or scattered according to the immediate whims of the user. Disassembly and reassembly can be accomplished with great speed, and replacement of consumable lighting components is similarly easy to perform.

It should also be noted that the present invention encompasses numerous embodiments in addition to the construction module 10 of FIGS. 1-7. Some such additional exemplary embodiments of the present invention are illustrated in FIGS. 8-12. Elements illustrated in FIGS. 8-12, which correspond substantially to the elements described above with reference to FIGS. 1-7, have been designated by corresponding reference numerals increased by one or more increments of one thousand. The embodiments of the present invention shown in FIGS. 8-12 operate and are constructed in manners consistent with the foregoing description of the construction module 10, unless stated otherwise.

Figure 8:
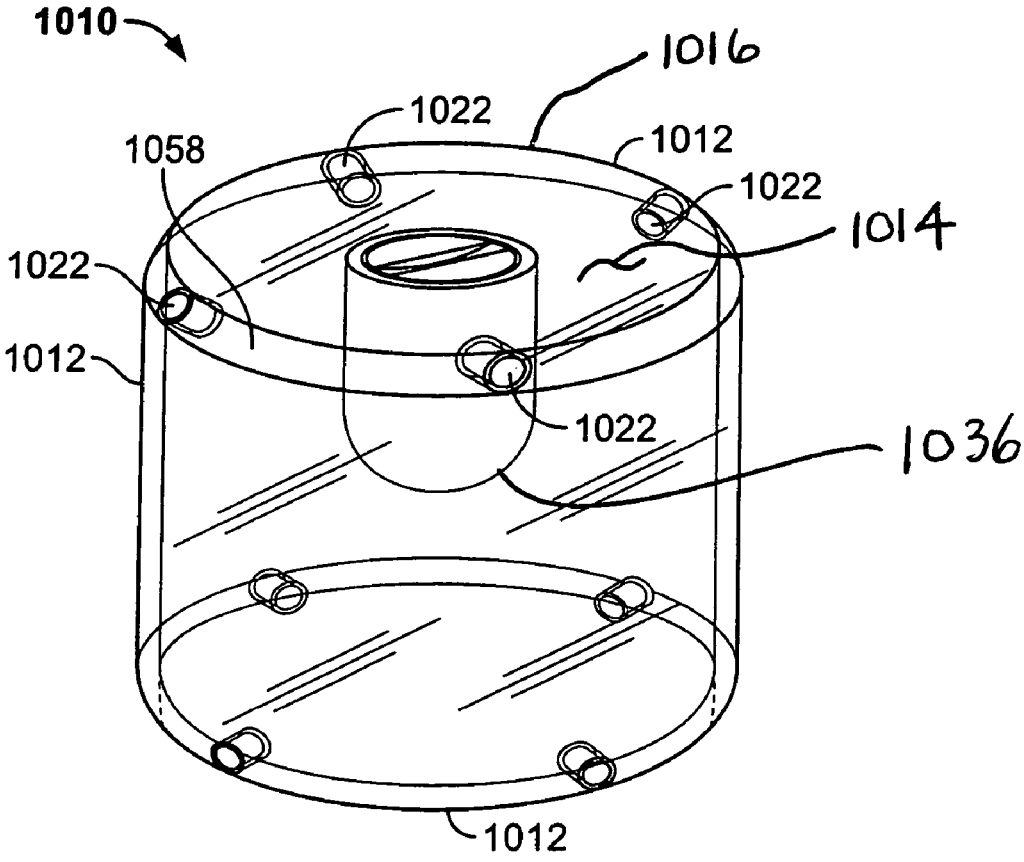
FIG. 8 is a perspective view of a construction module constructed in accordance with a second embodiment of the present invention, wherein the three-dimensional shape thereof is that of a cylinder.

FIG. 8 shows a construction module 1010 constructed in accordance with a second embodiment of the present invention. The three-dimensional shape of the construction module 1010 is that of a cylinder. The panel 1012 forming the sides of the cylindrical shape of the construction module 1010 is arcuate, and the panels 1012 forming the top and bottom of the cylindrical shape are flat. The construction module 1010 includes an internal light cartridge 1036 mounted to a panel 1012 and magnets 1022 mounted at the cylinder's edges 1016. For purposes of further discussion hereinafter (i.e., with reference to FIGS. 11 and 12), the construction module 1010 is shown with the panel 1012 forming the bottom of the cylindrical shape facing upward, exposing an annular beveled surface 1058 at one of the edges 1016 into which four magnets 1022 are embedded.

Figure 9:
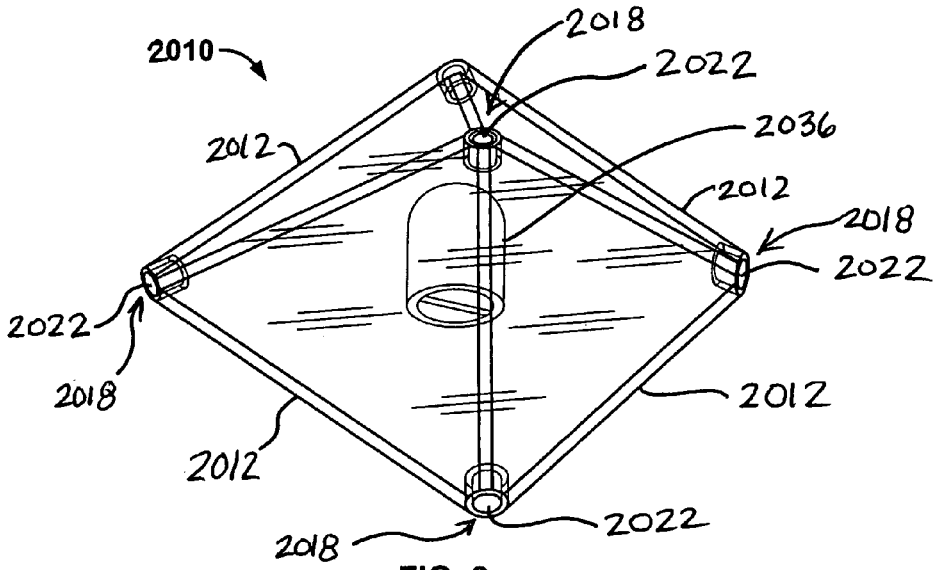
FIG. 9 is a perspective view of a construction module constructed in accordance with a third embodiment of the present invention, wherein the three-dimensional shape thereof is that of a pyramid.

FIG. 9 shows a construction module 2010 constructed in accordance with a third embodiment of the present invention. The three-dimensional shape of the construction module 2010 is that of a pyramid. The construction module 2010 includes an internal light cartridge 2036 mounted to a panel 2012 and magnets 2022 mounted at the pyramid's corners 2018.

Figure 10:
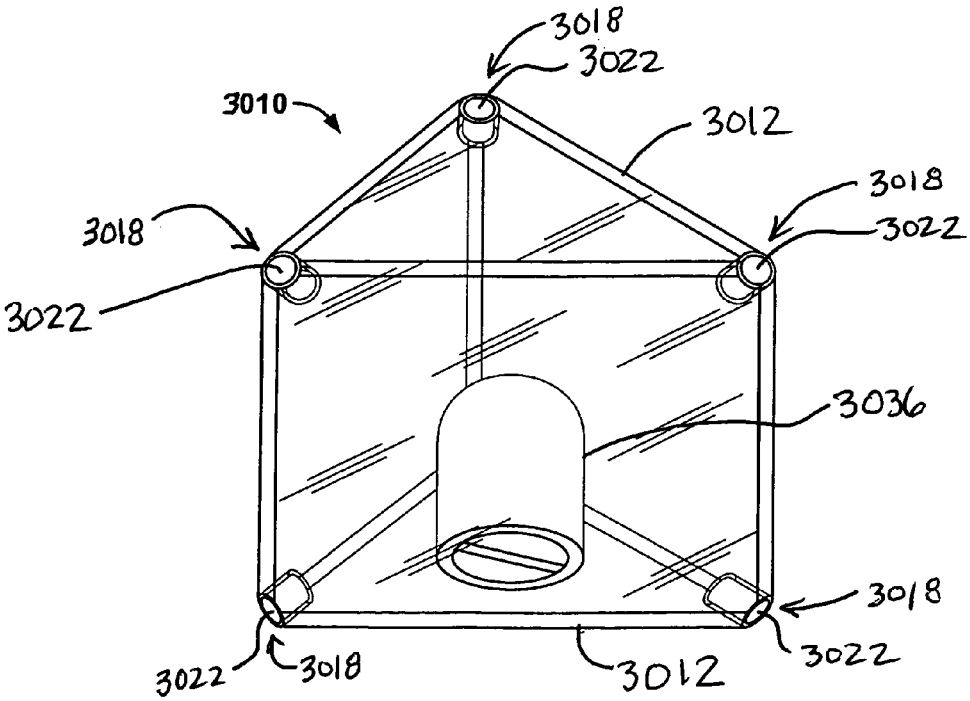
FIG. 10 is a perspective view of a construction module constructed in accordance with a fourth embodiment of the present invention, wherein the three-dimensional shape thereof is that of a prism.

FIG. 10 shows a construction module 3010 constructed in accordance with a fourth embodiment of the present invention. The three-dimensional shape of the construction module 3010 is that of a prism. The construction module 3010 includes an internal light cartridge 3036 mounted to a panel 3012 and magnets 3022 mounted at the prism's corners 3018.

Figure 11:
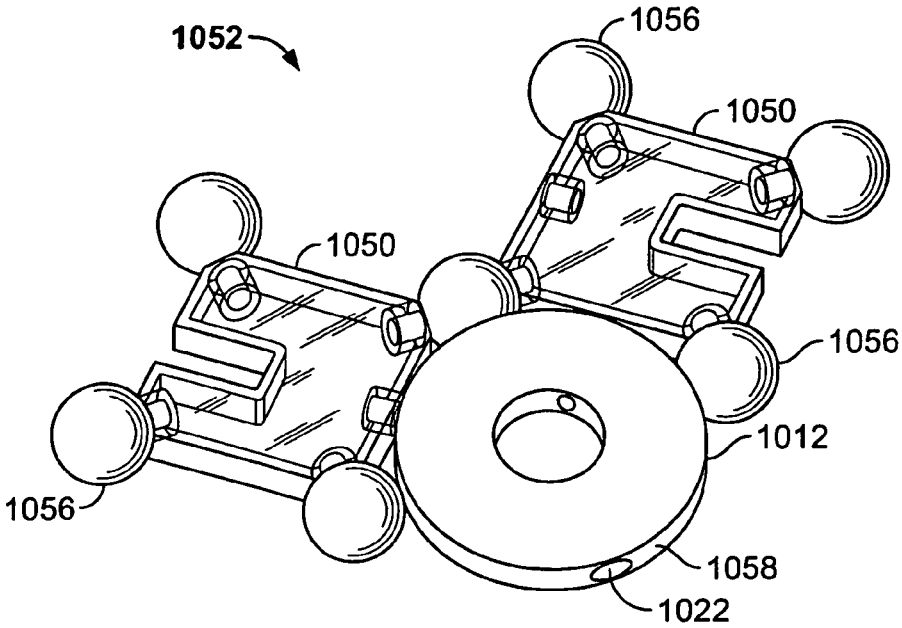
FIG. 11 is a perspective view of an construction composed in part of the flat bottom panel of the FIG. 8 construction module.
Figure 12:
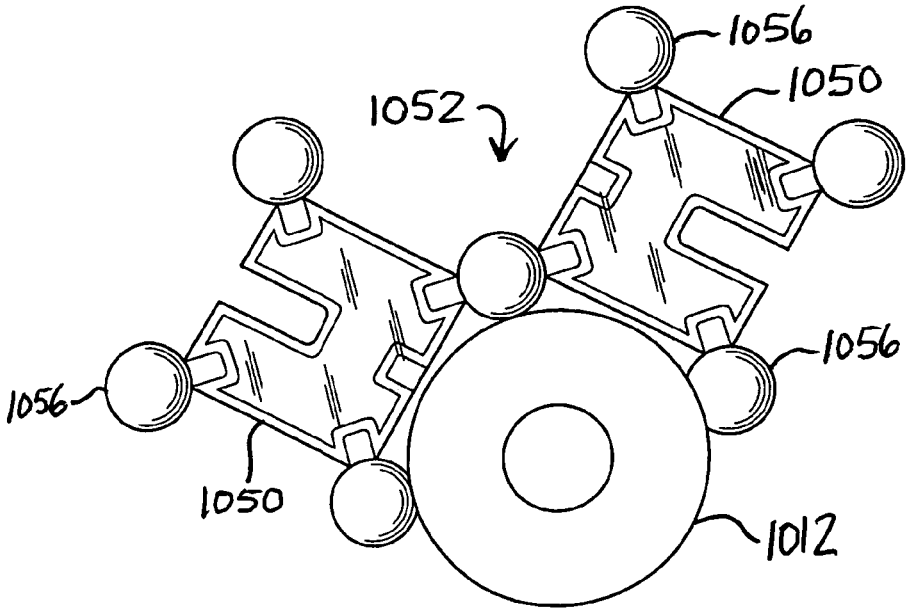
FIG. 12 is a top plan view of the construction of FIG. 11.

FIGS. 11 and 12 are respective perspective and top plan views of an construction 1052 composed in part of the above-discussed panel 1012 which forms the flat bottom of the cylindrical shape of the construction module 1010 of FIG. 8. As shown in FIGS. 11 and 12, the construction 1052 contains further construction elements, i.e., numerous stainless steel balls 1056 and two planar construction elements 1050. The annular beveled surface 1058 in which the magnets 1022 are embedded faces downward and outward and is oriented at a 45 degree angle to the downward-facing surface 1014 (FIG. 8) of the panel 1012. As such, the panel 1012 is somewhat elevated with respect to the stainless steel balls 1056 and the planar construction elements 1050. In addition, and as best shown in the top view of FIG. 12, there exists ample horizontal clearance between the planar construction elements 1050 and the panel 1012, enabling the cylindrically-shaped construction module 1010 (FIG. 8) to be integrated smoothly into the construction 1052.

It will be understood that the embodiments of the present invention described herein are merely exemplary and that a person skilled in the art may make many variations and modifications without departing from the spirit and scope of the invention. All such variations and modifications, including those discussed above, are therefore intended to be included within the scope of the present invention.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A construction module, comprising:

a plurality of substantially transparent panels forming a three-dimensional shape;

a self-powered light cartridge within the three-dimensional shape, the cartridge including a housing disposed on a panel of the plurality of substantially transparent panels, a light located within the housing and positioned approximately in the center of the three-dimensional shape, circuitry within the housing for controlling an operation of the light, a battery within the housing for powering the light via the circuitry, and a removable cover for sealing the light, circuitry and battery within the housing; and a plurality of externally directed magnets, wherein the removable cover is recessed with respect to an exterior surface of the panel.

2. The construction module of claim 1, wherein the construction module magnetically couples with other magnetic or ferromagnetic objects to form a structure.

3. A construction module, comprising:

a plurality of substantially transparent panels forming a three-dimensional shape;

a self-powered light cartridge within the three-dimensional shape, the cartridge including a housing disposed on a panel of the plurality of substantially transparent panels, a light located within the housing and positioned approximately in the center of the three-dimensional shape, circuitry within the housing for controlling an operation of the light, a battery within the housing for powering the light via the circuitry, and a removable cover for sealing the light, circuitry and battery within the housing; and a plurality of externally directed magnets, the plurality of transparent panels comprising a first panel having a first finger disposed at a first corner of the first panel, and a second panel having a second finger disposed at a second corner of the second panel, wherein the first corner and the second corner are adjacent a beveled corner surface of the construction module, and wherein a magnet of the plurality of externally directed magnets is disposed in the first finger and the second finger such that an end surface of the magnet is substantially coplanar with the beveled corner surface.

4. The construction module of claim 3, wherein the construction module magnetically couples with other magnetic or ferromagnetic objects to form a structure.

5. A construction kit, comprising:

a plurality of construction modules, each construction module having a plurality of translucent panels forming a three-dimensional shape, a self-powered light cartridge within the three-dimensional shape, and a plurality of externally directed magnets, the plurality of translucent panels comprising a first panel having a first finger disposed at a first corner of the first panel, and a second panel having a second finger disposed at a second corner of the second panel, wherein the first corner and the second corner are adjacent a beveled corner surface of the construction module, and wherein a magnet of the plurality of externally directed magnets is disposed in the first finger and the second finger such that an end surface of the magnet is substantially coplanar with the beveled corner surface; and a plurality of ferromagnetic spheres, wherein the plurality of construction modules and the plurality of ferromagnetic spheres magnetically attract to form a structure.

6. The construction kit of claim 5, wherein the translucent panels are transparent.

7. The construction kit of claim 5, wherein each construction module contains two substantially equivalent halves defining an interior chamber and wherein the self-powered light cartridge is affixed within the interior chamber.

8. The construction kit of claim 5, wherein a construction module of the plurality of construction modules is a cube having six substantially flat sides and eight corners with at least one magnet in the vicinity of each of the corners.

9. The construction kit of claim 5, wherein the plurality of construction modules includes construction modules of various shapes.

10. The construction kit of claim 5, further comprising a plurality of connecting elements for magnetically coupling with the plurality of construction modules and the plurality of ferromagnetic spheres.

11. The construction kit of claim 10, wherein the connecting elements include a magnet.

12. The construction kit of claim 5, further comprising:

a plurality of connecting members, each connecting member being magnetically attracted to a construction module of the plurality of construction modules or a connecting member of the plurality of connecting members.

13. The construction kit of claim 5, wherein three-dimensional shapes of the plurality of construction modules comprise at least one of a prism, a cylinder, a pyramid, and a cube.

14. The construction kit of claim 5, wherein the light cartridge includes an LED light.

15. The construction kit of claim 5, wherein the light cartridge includes a removable cover that is recessed within an exterior surface of a panel of the plurality of translucent panels.

16. A construction kit, comprising:

a plurality of construction modules, each construction module having a plurality of translucent panels forming a three-dimensional shape, a self-powered light cartridge within the three-dimensional shape, and a plurality of externally directed magnets, the plurality of translucent panels comprising a first panel having a first finger disposed at a first corner of the first panel, and a second panel having a second finger disposed at a second corner of the second panel, wherein the first corner and the second corner are adjacent a beveled corner surface of the construction module, and wherein a magnet of the plurality of externally directed magnets is disposed in the first finger and the second finger such that an end surface of the magnet is substantially coplanar with the beveled corner surface; and a plurality of connecting elements, each connecting element being magnetically attracted to a construction module of the plurality of construction modules.

17. The construction kit of claim 16, wherein the plurality of connecting elements includes at least one of a ferromagnetic ball and a connecting rod.

18. The construction kit of claim 16, wherein three-dimensional shapes of the plurality of construction modules comprise at least one of a prism, a cylinder, a pyramid, and a cube.

* * * * *